US007712596B2

(12) United States Patent
Park et al.

(10) Patent No.: US 7,712,596 B2
(45) Date of Patent: May 11, 2010

(54) BILL RECYCLE MACHINE

(75) Inventors: Chang Ho Park, Gyeonggi-do (KR); Jin Yong Hwang, Gyeonggi-do (KR)

(73) Assignee: Nautilus Hyosung Inc., Seoul (KR)

( * ) Notice: Subject to any disclaimer, the term of this patent is extended or adjusted under 35 U.S.C. 154(b) by 73 days.

(21) Appl. No.: 11/961,713

(22) Filed: Dec. 20, 2007

(65) Prior Publication Data

US 2008/0156613 A1 Jul. 3, 2008

(30) Foreign Application Priority Data

Dec. 29, 2006 (KR) ..... 10-2006-0138993

(51) Int. Cl.
*G07F 7/04* (2006.01)

(52) U.S. Cl. ..... 194/206

(58) Field of Classification Search ..... 194/206
See application file for complete search history.

(56) References Cited

U.S. PATENT DOCUMENTS 2,530,670 A * 11/1950 Von Hofe ..... 271/31
4,355,711 A * 10/1982 Hirose ..... 194/206
7,497,339 B2 * 3/2009 Nagura ..... 209/534
2007/0062782 A1 * 3/2007 Yoshikawa et al. ..... 194/206

* cited by examiner

*Primary Examiner*—Patrick Mackey
*Assistant Examiner*—Mark Beauchaine
(74) *Attorney, Agent, or Firm*—Fish & Richardson P.C.

(57) ABSTRACT

Disclosed is a bill recycle machine, in which a separation part for separating bills from each other and a push plate are installed at the same level as a bill receiving space, and an elevation plate is removed, so that a simple structure and small volume thereof can be achieve. The bill recycle machine includes: a front plate forming a wall surface of a front side of a bill receiving space formed at a lower part of a shutter, the front plate rotating about a hinge shaft of an upper part of the front plate; a push plate forming a first bill receiving space between the push plate and the front plate; a stack plate installed at an opposite side of the first bill receiving space, based on the push plate, so as to support bills stacked through a stack wheel; a transfer plate forming a second bill receiving space between the transfer plate and the stack plate; and a pickup roller installed at a position allowing the pickup roller to make contact with bills stacked in the first bill receiving space when the push plate moves frontward.

3 Claims, 9 Drawing Sheets

[Fig.1]
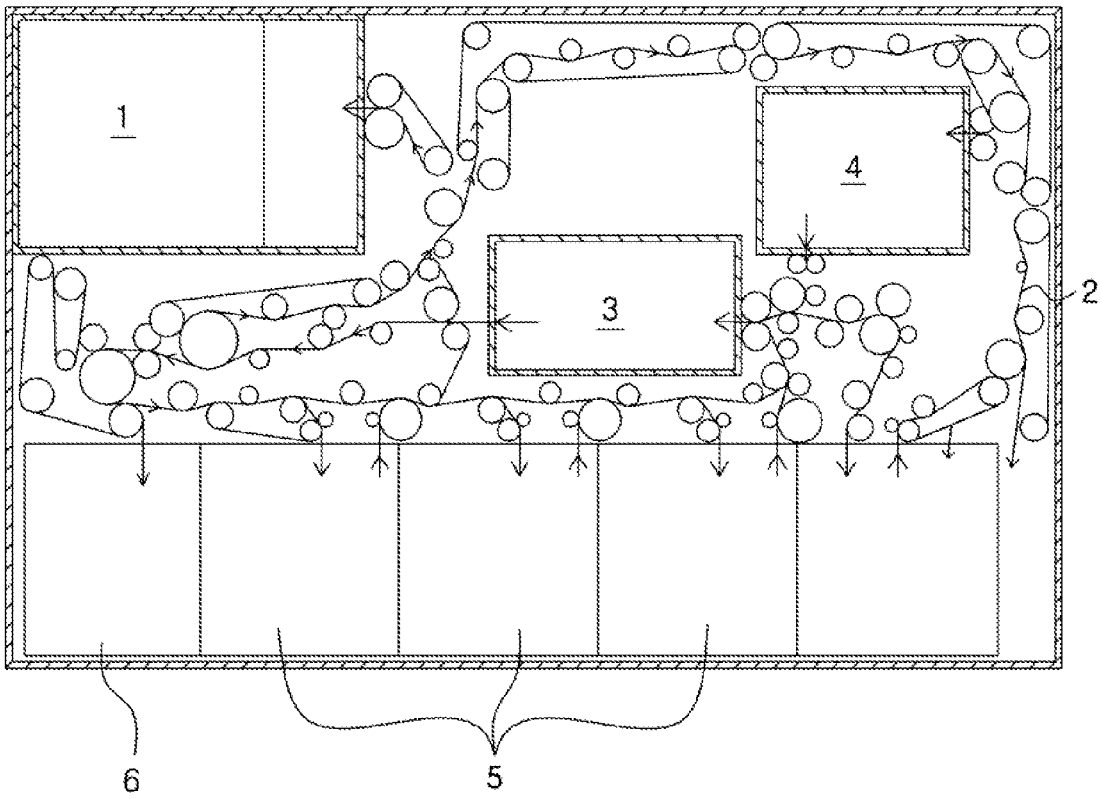

[Fig.2]
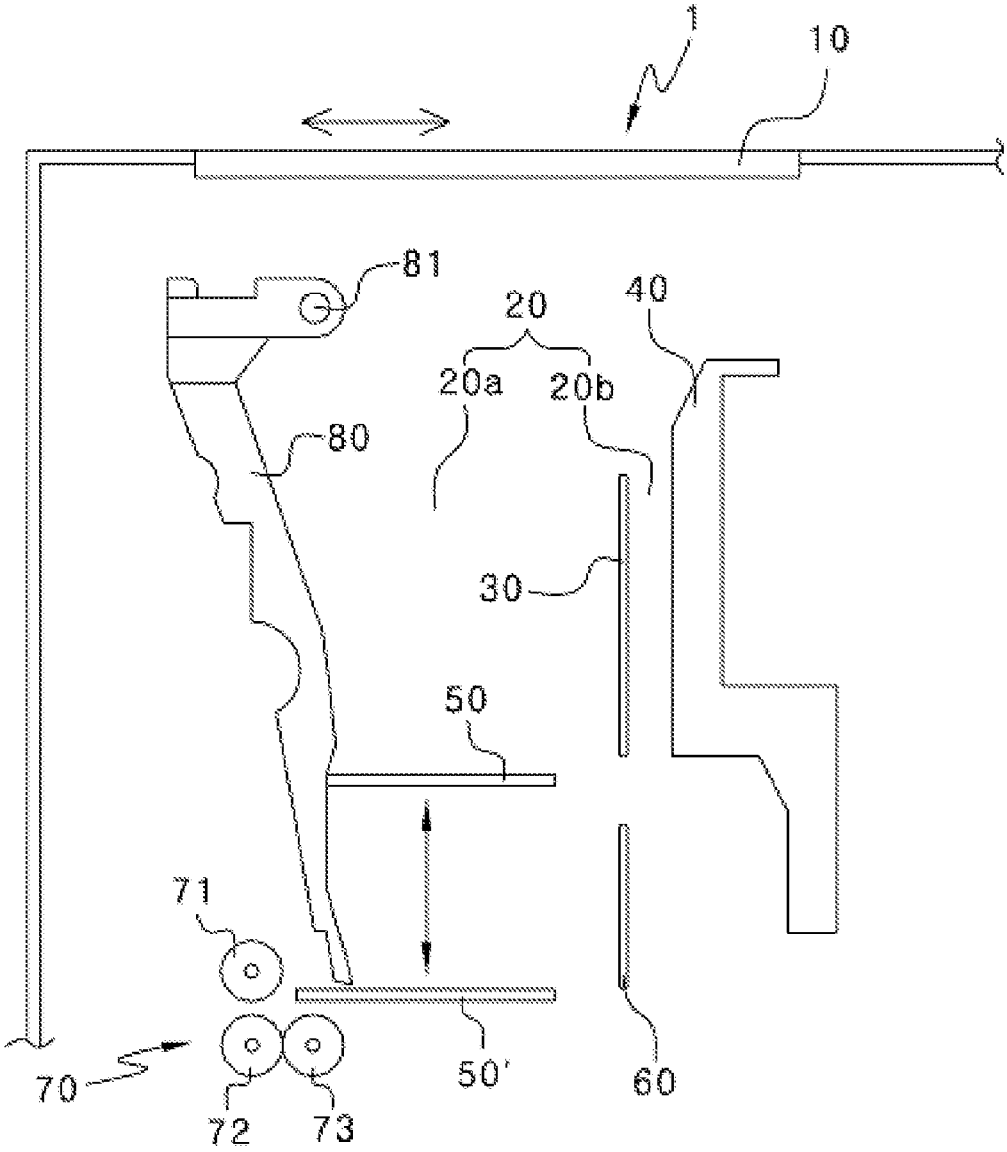

[Fig.3]
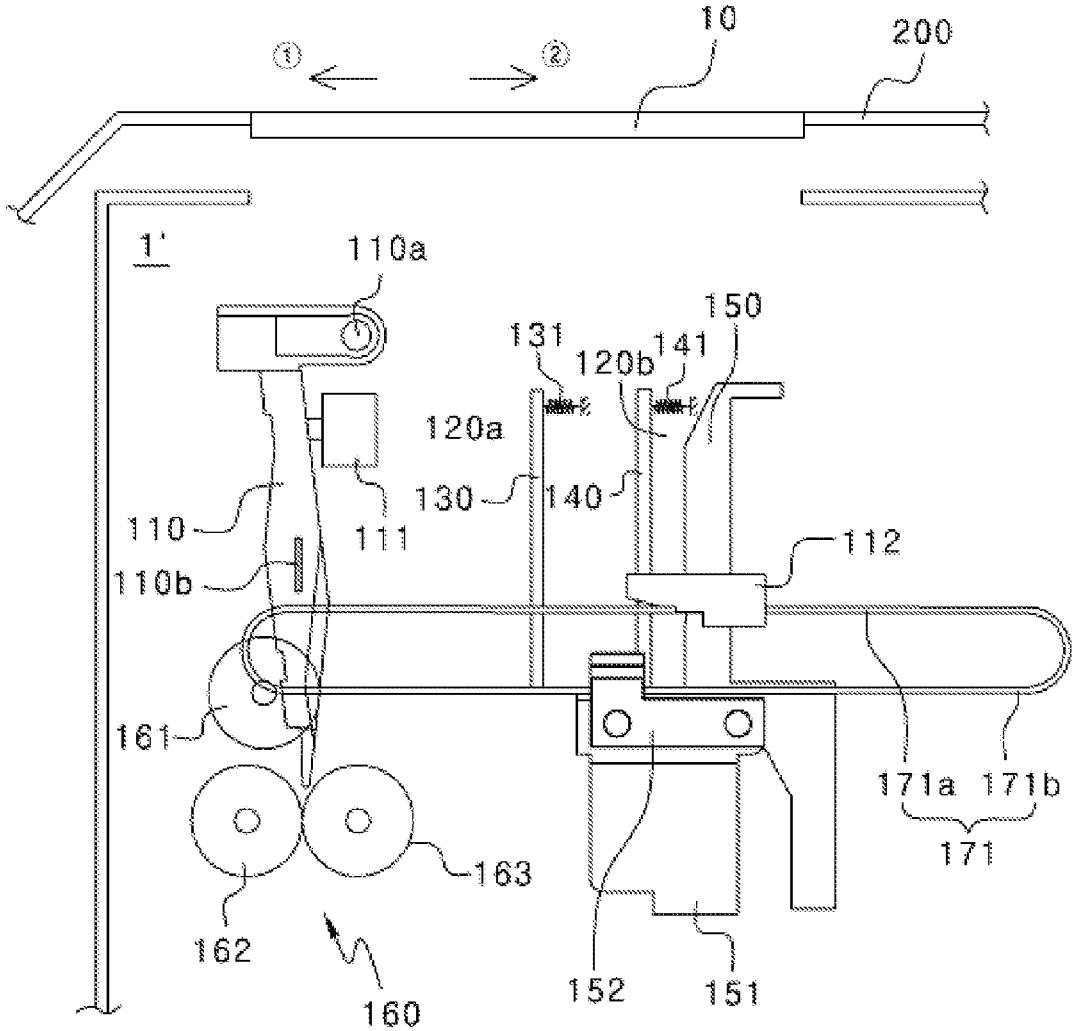

[Fig.4a]
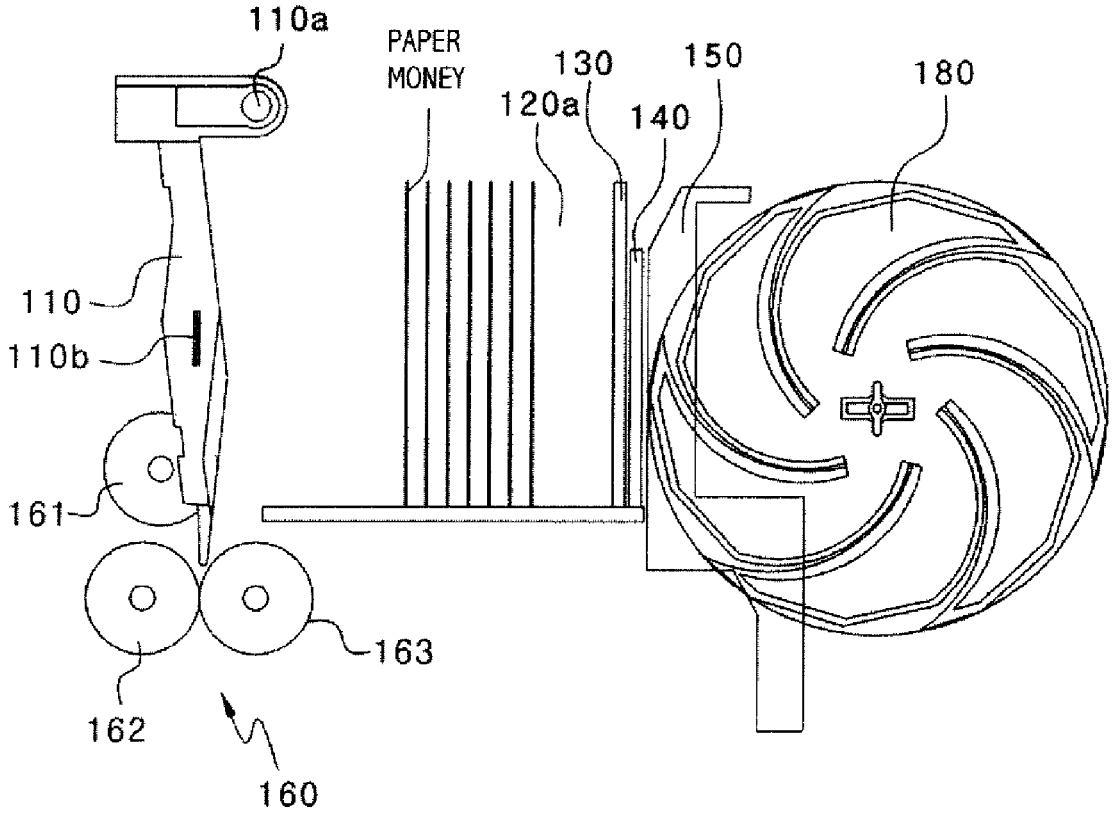

[Fig.4b]
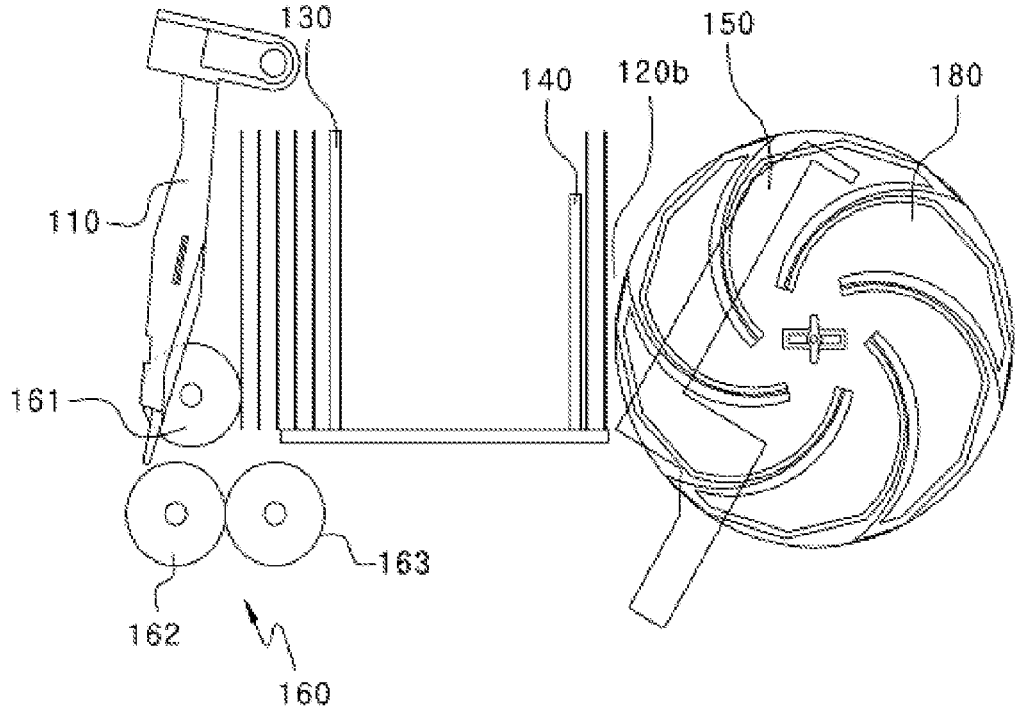

[Fig.4c]
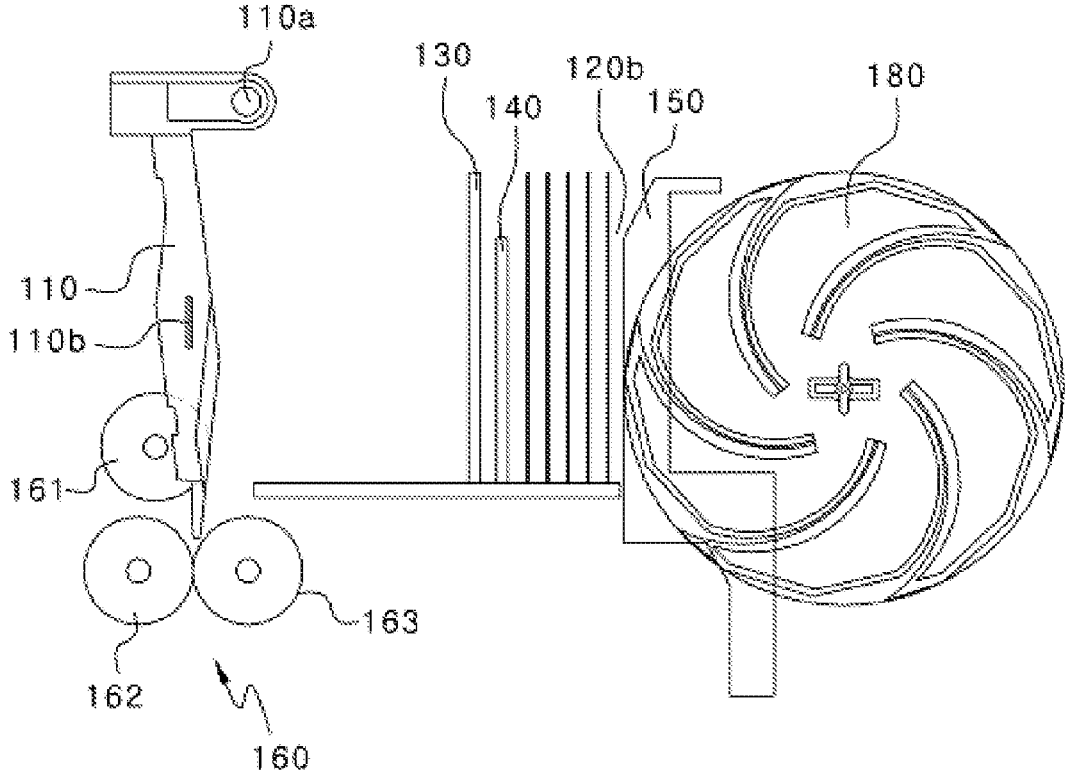

[Fig.5a]
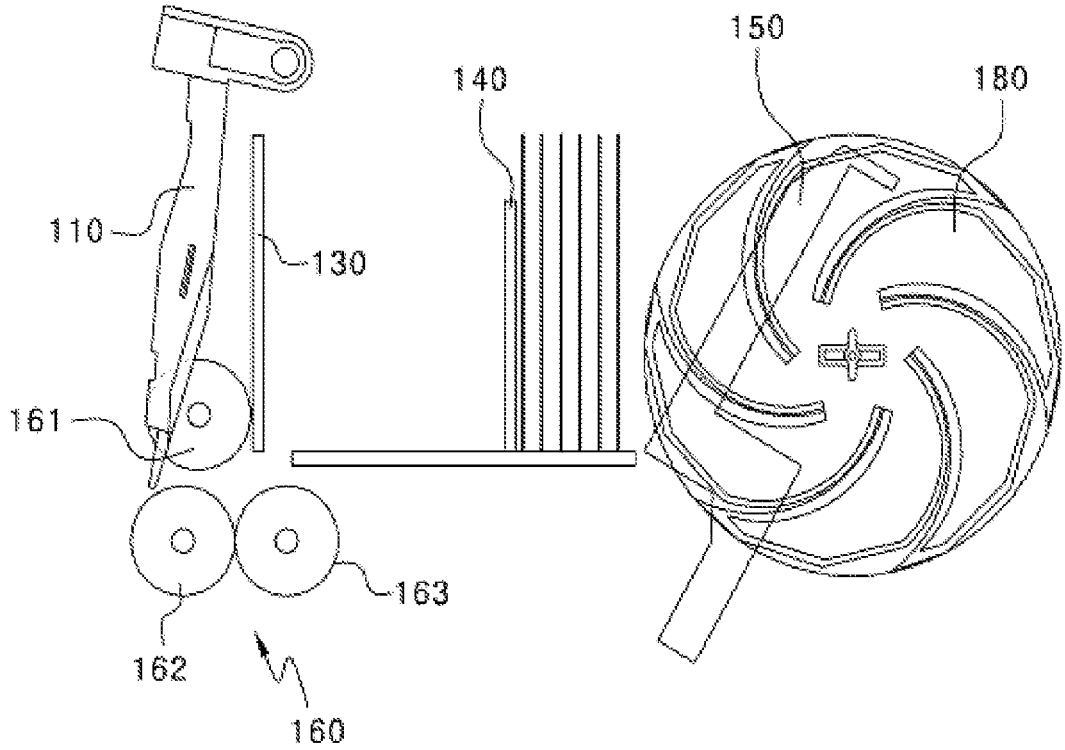

[Fig.5b]
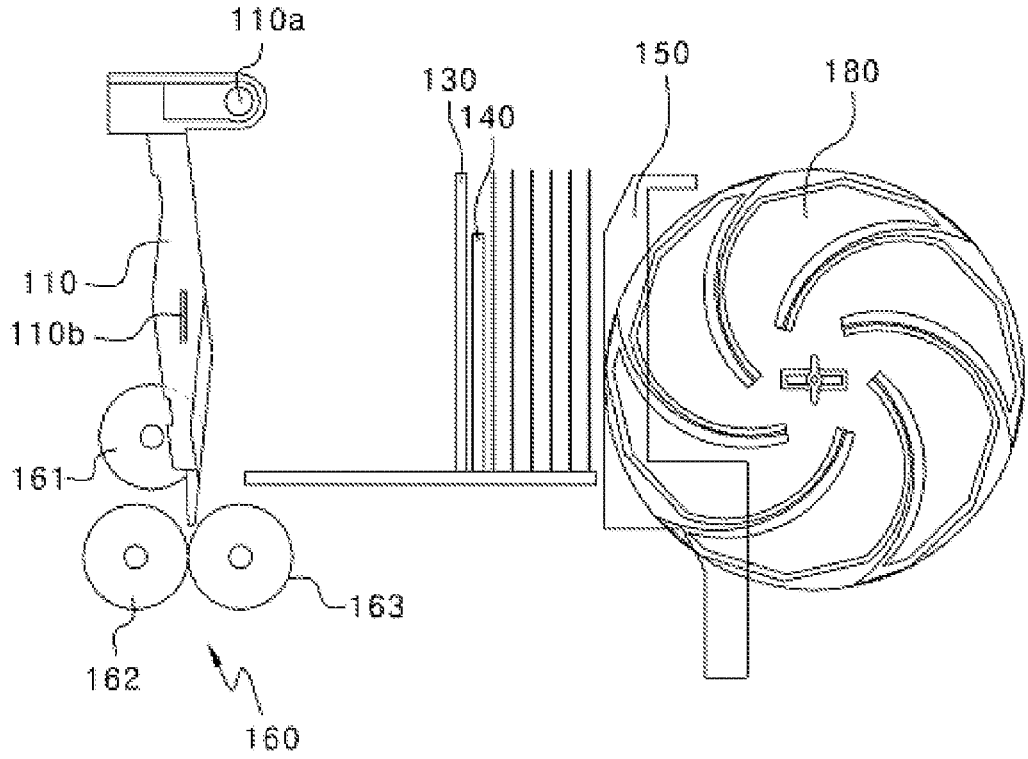

[Fig.5c]
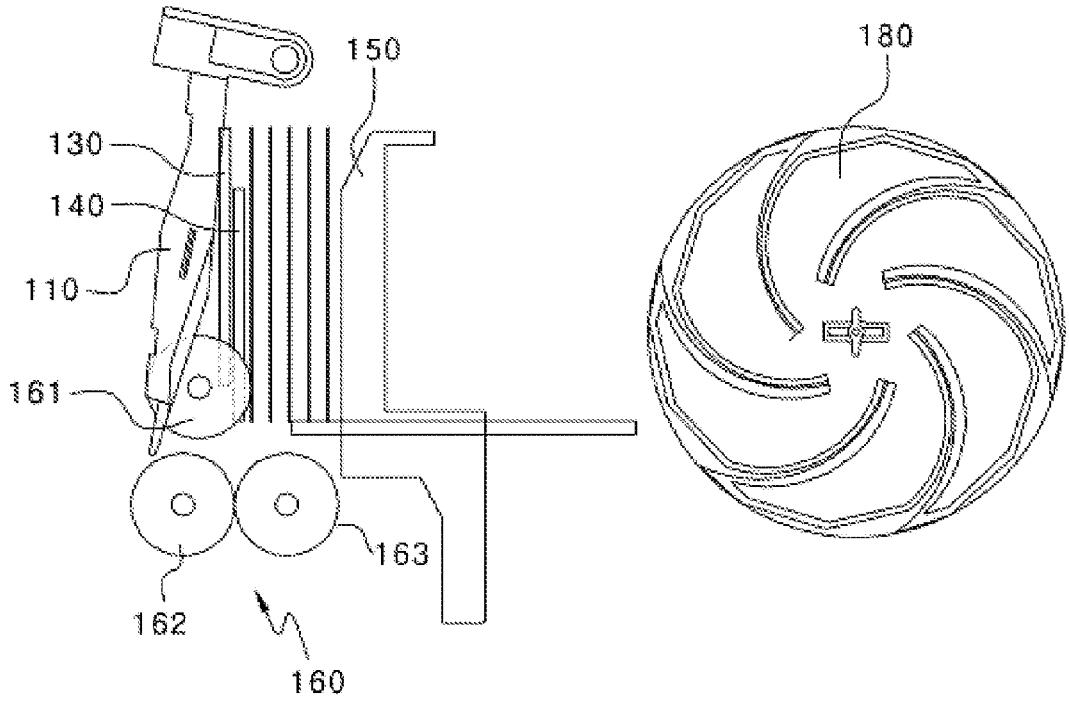

BILL RECYCLE MACHINE

TECHNICAL FIELD

The present invention relates to a bill recycle machine, and more particularly to a bill recycle machine which is installed at the interior of an automatic teller machine so as to control depositing and withdrawing bills.

BACKGROUND ART

In general, an Automated Teller Machine (ATM) includes an input part by which a customer inputs information, a screen part displaying financial service menus and a transaction situation, and a bill recycling machine through which the customer can insert or receive bills in order to perform depositing/withdrawing transaction, and the customer can deposit/withdraw bills through the bill recycling machine.

FIG. 1 is a side perspective view illustrating a typical bill recycling machine, and FIG. 2 is a side perspective view illustrating an input/output part of the bill recycling machine, through which bills are inserted/withdrawn by the customer.

With reference FIG. 1, an ATM through which bills are deposited/withdrawn includes: a controller performing a control operation so that overall operation of the bill recycling machine including an operation of depositing/withdrawing bills are controlled; a depositing/withdrawing part 1 through which the customer inserts or receives bills in order to deposit/withdraw the bills; a returning path 2 along which bills deposited/withdrawn through the depositing/withdrawing part 1 are transferred; an identifying part 3 installed at the returning path 2 so as to identify if any error regarding the bills exists; a temporary storage part 4 in which the inserted bills, after passing through the identifying part 3, are temporarily stacked; a plurality of recycling boxes 5 performing a recycling function so that bills inserted from the customer are stacked and the stacked bills are output; and a reject box 6 receiving bills which have been identified as erroneous bills at the identifying part 3.

As shown in FIG. 2, the depositing/withdrawing part 1 includes: a bill receiving space 20 formed at the lower part of a shutter 10 which is opened/closed so as to allow the customer to insert bills when depositing the bills and to receive bills when withdrawing; a stack plate 30 divides the bill receiving space 20 into the first bill receiving space 20*a* and the second bill receiving space 20*b*; a transfer plate 40 is positioned so as to make contact with the stack plate 30 in an initialization state as a standby stage for depositing/withdrawing bills; an elevation plate 50 installed at the lower part of the first bill receiving space 20*a* so as to be elevated; a push plate 60 pushing bills toward a separating part 70 in a state where bills are stacked on the elevation plate 50 and are moved downward; the separating part 70 separating the bills pushed by the push plate 60 from each other; and a front plate 80 forming a wall surface of a front side of the bill receiving space 20 formed at the lower part of the shutter 10.

The separating part 70 includes a pickup roller 71 allowing bills to be separated from each other, a feed roller 72 feeing each bill divided by the pickup roller 71, and a guide roller 73 making contact with the feed roller 72 so as to prevent the bills from being separated from each other.

DISCLOSURE

Technical Problem

In a bill cycle machine having such a structure, when a customer inserts bills into a first bill receiving space 20*a* so as to deposit the bills, the bills have to be separated after an elevation plate 50*a* is moved downward because a separating part 70 has to be positioned at the lower part of the first bill receiving space 20*a*. Therefore, the bill cycle machine has to include a separation device which can elevate the elevation plate 50, thereby having a complicated structure.

Also, a push plate 60 and the separating part 70 are positioned at the lower part of the bill receiving space 20, thereby increasing volume of the machine.

The present invention has been made in view of the above-mentioned problems, and the present invention provides a bill recycle machine including a separation part for separating bills from each other and a push plate installed at the same level as a bill receiving space, in which an elevation plate is removed, thereby having a simple structure and small volume.

Technical solution

In accordance with an aspect of the present invention, there is provided a bill recycle machine including: a front plate forming a wall surface of a front side of a bill receiving space formed at a lower part of a shutter, the front plate rotating about a hinge shaft of an upper part of the front plate; a push plate forming a first bill receiving space between the push plate and the front plate; a stack plate installed at an opposite side of the first bill receiving space, based on the push plate, so as to support bills stacked through a stack wheel; a transfer plate forming a second bill receiving space between the transfer plate and the stack plate; and a pickup roller installed at a position allowing the pickup roller to make contact with bills stacked in the first bill receiving space when the push plate moves frontward.

In this case, the bill recycle machine as claimed in claim 1, wherein the front plate is locked by a solenoid when bills are deposited so as to prevent a separation part of a lower side of the front plate from being exposed.

Also, the bill recycle machine as claimed in claim 1, wherein the push plate and the stack plate are installed in such a manner as to be pulled by each spring in a direction of the transfer plate; the push plate is moved frontward by restoring force of a spring; and the stack plate is pushed by the transfer plate so that the stack plate moves frontward while overcoming force by the spring and moves backward along with the transfer plate due to restoring force of the spring when the transfer plate moves backward.

Advantageous Effects

According to a bill recycle machine according to the present invention, a separation part for separating bills from each other and a push plate are installed at the same level as a bill receiving space, and the push plate, a stack plate, and a transfer plate are arranged in a line so that simple structure of the bill recycle machine and reduced volume thereof can be achieved.

BRIEF DESCRIPTION OF THE DRAWINGS

The foregoing and other objects, features and advantages of the present invention will become more apparent from the following detailed description when taken in conjunction with the accompanying drawings in which:

FIG. 1 is a side schematic view illustrating a typical bill recycle machine;

FIG. 2 is a side schematic view illustrating a depositing/withdrawing part of a bill recycle machine, through which a customer inserts and receives bills;

FIG. 3 is a side schematic view illustrating a bill recycle machine according to an embodiment of the present invention;

FIGS. 4*a*, 4*b* and 4*c* are views illustrating the procedure of depositing bills through a bill recycle machine according to the present invention; and FIGS. 5*a*, 5*b* and 5*c* are views illustrating the procedure of withdrawing bills through a bill recycle machine according to the present invention.

BEST MODE

Mode for Invention

Hereinafter, the construction and function of an exemplary embodiment of the present invention will be described with reference to the accompanying drawings. In the following description, the same elements will be designated by the same reference numerals although they are shown in different drawings.

FIG. 3 is a side schematic view illustrating a bill recycle machine according to an embodiment of the present invention. Hereinafter, as shown in FIG. 3, the direction of an error ① refers to 'a front direction,' and the direction of an error ② refers to 'a rear direction.'

The present invention is a bill recycle machine through which a customer inserts bills so as to deposit the bills or receives bills which have been withdrawn, and a shutter 10 is installed at the upper part of the bill recycle machine. Although the shutter 10 can be installed at the upper part of the bill recycle machine as shown in FIG. 1, the shutter 10 can be installed at an outer case 200 of an ATM according to the present embodiment.

A separating part 160 is included at a lower depositing/withdrawing part 1' of the shutter 10 so as to separate bills from each other. The separating part 160 includes a pickup roller 161 allowing bills to be separated from each other, a feed roller 162 feeding the bill separated by the pickup roller 161, and a guide roller 163 making contact with the feed roller 162 so as to prevent bills from being stuck together. The pickup roller 161 of the separating part 160 is installed at a level similar to the level of the lower part of inserted bills in a vertical direction so as to make contact with the lower part of inserted bills when the customer inserts the bills so as to deposit them. Also, a separation pressure sensor (not shown) is installed at a front side of the pickup roller 161 so as to sense if the pickup roller 161 is pushed frontward to a position allowing the pickup roller 161 to obtain frictional force required for separating bills.

A front plate 110 rotating about a hinge shaft 110 of the upper part thereof is installed at an upper side of the separation part 160. When bills are inserted, the front plate 100 rotates about the hinge shaft 110*a* in a counter-clockwise direction so as to prevent alien substances from flowing into the separating part 160 so that the pickup roller 161 can be prevented from being exposed. In order to this, a solenoid 111 is installed at a side part of the bill recycle machine so as to pull the front plate 110 toward the front bill receiving space 120*a* so that the front plate 110 covers the upper part of the pickup roller 161.

Also, when bills are separated, the front plate 110 rotates about the hinge shaft 110*a* in a clockwise direction so that the pickup roller 161 is exposed so as to make contact with bills stacked in the first bill receiving space 120*a*.

A push plate 130 is installed so as to form the first bill receiving space 120*a* between the push plate 130 and the front plate 110, and to push the bills stacked in the first bill receiving space 120*a* toward the pickup roller 161 so as to apply separation pressure.

A spring 131 is connected with the push plate 130 in such a manner that the spring 131 pulls the push plate 130 in the rear direction. In a case where the push plate 130 is moved in the front direction, the push plate is moved while overcoming pulling force exerted by the spring 131 by means of driving of the push plate driving motor (not shown). When the push plate driving motor is rotated in an opposite direction in a state where the push plate 130 has been moved in the front direction, the push plate 130 is moved in the rear direction by restoring force by the spring 131.

A stack plate 140 is installed at the rear part of the push plate 130 so as to support bills stacked through the stack wheel 180. A spring 141 is installed as the stack plate 140 so as to pull the stack plate in the rear direction. The stack plate 140 is not driven by a separate motor, but is moved frontward along with frontward movement of a transfer plate 150. The stack plate 140 is moved backward by the restoring force of the spring 141 along with the backward movement of the transfer plate 150. In this state, a limit position (herein, refers to a 'stack position'), where the spring 141 is moved backward by restoring force of the spring 141, is restricted by a stopper (not shown).

The second bill receiving space 120*b* is formed in the rear direction of the stack plate 140, and the transfer plate 150 is installed in the rear direction of the stack plate 140 so that the second bill receiving space 120*b* is formed between the transfer plate 150 and the stack plate 140.

A belt 171 is installed at both sides of the transfer plate 150 so as to move the transfer plate 150 frontward and backward while the belt 171 is rotated by driving of a transfer plate driving motor (not shown).

A front plate pressure member 112 is installed at an upper line 171*a* of the belt 171. The front plate pressure member 112 is assembled with a tooth shape formed at the surface of the upper line 171*a* so that the front plate pressure member 112 is transferred frontward and backward as the belt 171 is rotated by driving of the transfer plate driving motor. When the front pressure member 120 is transferred frontward, the front pressure member 120 makes contact with a side plate 110*b* protruding in a side direction of the front plate 110 so as to rotate the front plate 110 about a hinge shaft 110*a* in a clockwise direction. Therefore, the pickup roller 161 is exposed toward a rear direction of the front plate 110.

The belt assembling member 152 is installed at a lower line 171*b* of the belt 171, and are assembled with a supporting plate 151 integrally assembled with the transfer plate 150 so that the belt assembling member 152 is transferred frontward and backward according to the rotation of the belt 171.

Hereinafter, the operation of the present invention having such a structure will be described. FIGS. 4*a*, 4*b* and 4*c* are views illustrating a procedure of depositing bills through the bill recycle machine according to the present invention.

With reference to FIG. 4*a*, when the customer selects a bill depositing menu, the push plate 130 and the transfer plate 150 move to a 'deposition standby position' which has been set. After this, the shutter 10 is opened so that the customer inserts bills into the first bill receiving space 120*a* so as to deposit the bills. In this case, so as to prevent alien substance from flowing into the pickup roller 161, the locked state of the front plate 110 is kept by a solenoid 111 in a state where the front plate 110 is rotated about the hinge shaft 110*a* in a counter-clockwise direction.

With reference to FIG. 4*b*, in a state where the bills are inserted into the first bill receiving space 120*a*, the shutter 10 is closed, and the solenoid 111 locking the front plate 110 is released. After this, the bills are arranged while the push plate 130 is repeatedly moved frontward and backward, and then the push plate 130 is moved frontward. The bills push the pickup roller 161 due to the front movement of the push plate 130, and the separation pressure sensor senses the position of the pickup roller 161. When the separation pressure sensor determines that the position is a 'separation position,' the push plate 130 is stopped.

Simultaneously, the transfer plate 150 is moved to a rear position, which is a 'withdrawal standby position' (a position allowing bills of the recycle box to be stacked in the second bill receiving space when the bills are withdrawn), and the stack plate 140 is moved to a 'stack position' so as to stack rejected bills among separation bills in the second bill receiving space 120*b*.

Meanwhile, when the transfer plate 150 moves backward to the 'withdrawal standby position,' the front pressure member 112 connected with the belt 171 is transferred frontward so as to push the side plate 110*b* of the front plate 110 and to rotate it about the hinge shaft 110*a*. Therefore, when bills are separated, interference caused by the front plate 110 can be removed.

In this state, the bills start to be separated by the pickup roller 161.

Then, with reference to FIG. 4*c*, when the bills are completely separated from each other, the push plate 130 is moved toward the stack plate 140, and the transfer plate 150 is moved to the 'deposition standby position.' If rejected bills among the separated bills are generated, and the rejected bill are stacked in the second bill receiving space 120*b*, the position of the push plate 130 is determined according to the number of rejected bills. Then the transfer plate 150 is positioned so as to allow the customer to receive the rejected bills, and when the customer receives the rejected bills, the transfer plate 150 is again transferred to the 'deposition standby position.' Therefore, the procedure of depositing bills is finished.

FIGS. 5*a*, 5*b* and 5*c* are views illustrating the procedure of withdrawing bills through the bill recycle machine according to the present invention.

With reference to FIG. 5*a*, according to the customer's request for drawing bills, bills of the recycle box (not shown) are stacked in the second bill receiving space 120*b*. In this case, the transfer plate 150 is transferred at the 'withdrawal standby position' so as to allow bills to flow into the second bill receiving space 120*b*, and the stack plate 140 is positioned at the 'stack position' so as to support bills flowing into the second bill receiving space 120*b*.

In this case, as the number of bills stacked in the second bill receiving space 120*b*, the stack plate 140 moves frontward while overcoming force of the spring 141. Herein, if the push plate 130 is positioned while making contact with the stack plate 140, there is a problem in that bills have to be stacked in the second bill receiving space 120*b* while overcoming force of two springs 131 and 141. Therefore, when bills are stacked in the second bill receiving space 120*b*, the push plate 130 is preferably spaced a predetermined distance from the stack plate 140 so as not to make contact with the stack plate 140 according to the increase of the number of bills. In this case, since it is required to sense the position of the push plate 130, the present invention has structure where the push plate 130 pushes the pickup roller 161 so as to allow the separation pressure sensor to sense it so that the push plate 130 is moved frontward to the position determined as a 'separation pressure position.'

With reference to FIG. 5*b*, transfer plate 150 is transferred from the 'withdrawal standby position' to the 'deposition standby position,' and the push plate 130 spaced a predetermined distance from the stack plate 140 is moved toward the stack plate 140. After this, the customer transfers the transfer plate 150 frontward to a proper position allowing the customer to receive bills stacked in the second bill receiving space 120*b*, and then the customer receives the bills. Accordingly, the procedure of drawing bills is finished.

If the customer does not receive the bills stacked in the second bill receiving space 120*b*, as shown in FIG. 4*c*, the transfer plate 150 is transferred frontward until the separation pressure sensor senses it, and then the bills start to be separated by the pickup roller 161 so that a retrieving process is performed.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A bill recycle machine comprising:

a front plate forming a wall surface of a front side of a bill receiving space formed at a lower part of a shutter and having a side plate that protrudes from a side of the front plate for rotating the front plate in a clockwise direction;

a push plate forming a first bill receiving space between the push plate and the front plate, with a spring being installed in the push plate for activating the push plate to move;

a separation part disposed below the front plate for separating bills, with the separation part and the push plate being installed at the same level as a first bill receiving space formed between the push plate and the front plate;

a stack plate installed at an opposite side of the first bill receiving space, based on the push plate, so as to support bills stacked through a stack wheel, with another spring being installed in the stack plate for activating the stack plate to move;

a transfer plate forming a second bill receiving space between the transfer plate and the stack plate;

a front plate pressure member which is installed at an upper line of a belt installed at both sides of the transfer plate, the front plate pressure member being tooth shaped and formed at a surface at the upper line of the belt;

a pickup roller installed at a position allowing the pickup roller to make contact with bills stacked in the first bill receiving space when the push plate moves frontward, wherein the front plate rotates about a hinge shaft of an upper part of the front plate for thereby preventing alien substances from flowing into the separation part, so that the pickup roller can be prevented from being exposed to the outside, and the push plate, the stack plate, and the transfer plate are all arranged in one line.

2. The bill recycle machine as claimed in claim 1, wherein the front plate is locked by a solenoid when bills are deposited so as to prevent a separation part installed below the front plate from being exposed.

3. The bill recycle machine as claimed in claim 1, wherein:

the push plate and the stack plate are installed in such a manner as to be pulled by the springs installed in the push plate and the stack plate in a direction of the transfer plate;

the push plate is moved frontward by restoring force of a spring; and the stack plate is pushed by the transfer plate so that the stack plate moves frontward while overcoming force by the spring and moves backward along with the transfer plate due to restoring force of the spring when the transfer plate moves backward.

* * * * *